US006776556B2

(12) United States Patent
Hessner

(10) Patent No.: US 6,776,556 B2
(45) Date of Patent: Aug. 17, 2004

(54) PAVING STONE SYSTEM

(76) Inventor: Erich C. Hessner, 108 1/2 Cherry St., Janesville, WI (US) 53545-3762

( * ) Notice: Subject to any disclaimer, the term of this patent is extended or adjusted under 35 U.S.C. 154(b) by 0 days.

(21) Appl. No.: 10/119,422

(22) Filed: Apr. 8, 2002

(65) Prior Publication Data

US 2002/0159836 A1 Oct. 31, 2002

Related U.S. Application Data

(60) Provisional application No. 60/287,451, filed on Apr. 30, 2001.

(51) Int. Cl.[7] ..... E01C 5/22

(52) U.S. Cl. ..... 404/44; 404/18; 404/82

(58) Field of Search ..... 404/44, 82, 72, 404/18, 29, 34

(56) References Cited

U.S. PATENT DOCUMENTS

| | | | | | |
|---|---|---|---|---|---|
| 2,033,028 | A | * | 3/1936 | Gaisman | 404/8 |
| 2,105,152 | A | | 1/1938 | Lattorf | 94/15 |
| 3,957,383 | A | * | 5/1976 | Fredericks | 404/8 |
| 3,963,506 | A | | 6/1976 | Shutt et al. | 106/67 |
| 3,969,851 | A | | 7/1976 | Whitacre | 52/98 |
| 4,213,926 | A | * | 7/1980 | Toyoda et al. | 264/74 |
| 4,973,192 | A | | 11/1990 | Hair | 404/34 |
| 5,035,532 | A | | 7/1991 | Gargollo | 404/41 |
| 5,281,047 | A | * | 1/1994 | Skaug | 404/42 |
| 5,583,079 | A | | 12/1996 | Golitz et al. | 504/32 |
| 5,645,369 | A | | 7/1997 | Geiger | 404/34 |
| 6,015,243 | A | | 1/2000 | Geiger | 404/38 |
| 6,079,900 | A | | 6/2000 | Kumagawa et al. | 404/82 |
| 6,280,669 | B2 | * | 8/2001 | Kistner et al. | 264/135 |

* cited by examiner

*Primary Examiner*—Thomas B. Will
*Assistant Examiner*—Tara L. Mayo

(57) ABSTRACT

A paving stone system for producing aesthetically pleasing paving stones. The paving stone system includes positioning a tile member within a container, applying a bonding agent to the tile member and filling the container with concrete. The tile member is comprised of a flat portion having an upper surface and a lower surface, a first side wall extending from the lower surface and a second side wall extending from the lower surface. The first side wall and the second side wall are preferably curved inwardly toward one another to lock within the concrete. A unique pattern may be applied to the upper surface of the tile member providing an aesthetically pleasing appearance.

16 Claims, 5 Drawing Sheets

PAVING STONE SYSTEM

CROSS REFERENCE TO RELATED APPLICATIONS

I hereby claim benefit under Title 35, United States Code, Section 119(e) of U.S. provisional patent application Serial No. 60/287,451 filed Apr. 30, 2001. The 60/287,451 application is currently abandoned. The 60/287,451 application is hereby incorporated by reference into this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to paving stones and more specifically it relates to a paving stone system for producing aesthetically pleasing paving stones in an efficient and cost effective manner.

2. Description of the Related Art

Paving stones have been in use for years. Conventional paving stones are manufactured by forming a body of material, such as clay, into a desired shape and then applying heat to the body until hardened into a rigid ceramic structure. Because of the expense of clay materials and manufacturing the same, one solution has been to form paving stones with dyed concrete to create the appearance of clay formed paving stone.

The main problem with conventional paving stones is that they require materials that are relatively expensive. Another problem with conventional paving stones is that they require a significant amount of energy to heat the entire body of material into a ceramic mass. A further problem with conventional paving stones is that they are relatively expensive making them difficult to utilize upon projects with low budgets. A problem with imitation paving stones (i.e. paving stones formed with dyed concrete) is that they are not durable nor as aesthetically pleasing as clay formed paving stones.

Examples of patented devices which are related to the present invention include U.S. Pat. No. 5,281,047 to Skaug; U.S. Pat. No. 3,969,851 to Whitacre; U.S. Pat. No. 2,105,152 to Lattorf; U.S. Pat. No. 6,079,900 to Kumagawa et al.; U.S. Pat. No. 5,035,532 to Gargollo; U.S. Pat. No. 4,973,192 to Hair; U.S. Pat. No. 5,645,369 to Geiger; U.S. Pat. No. 6,015,243 to Geiger; U.S. Pat. No. 5,583,079 to Golitz; and U.S. Pat. No. 3,963,506 to Shutt.

While these devices may be suitable for the particular purpose to which they address, they are not as suitable for producing aesthetically pleasing paving stones in an efficient and cost effective manner. Conventional paving stone manufacturing methods are not cost effective and inefficient to produce.

In these respects, the paving stone system according to the present invention substantially departs from the conventional concepts and designs of the prior art, and in so doing provides an apparatus primarily developed for the purpose of producing aesthetically pleasing paving stones in an efficient and cost effective manner.

BRIEF SUMMARY OF THE INVENTION

In view of the foregoing disadvantages inherent in the known types of paving stone devices now present in the prior art, the present invention provides a new paving stone system construction wherein the same can be utilized for producing aesthetically pleasing paving stones in an efficient and cost effective manner.

The general purpose of the present invention, which will be described subsequently in greater detail, is to provide a new paving stone system that has many of the advantages of the paving stones mentioned heretofore and many novel features that result in a new paving stone system which is not anticipated, rendered obvious, suggested, or even implied by any of the prior art paving stones, either alone or in any combination thereof.

To attain this, the present invention generally comprises positioning a tile member within a container, applying a bonding agent to the tile member and filling the container with concrete. The tile member is comprised of a flat portion having an upper surface and a lower surface, a first side wall extending from the lower surface and a second side wall extending from the lower surface. The first side wall and the second side wall are preferably curved inwardly toward one another to lock within the concrete. A unique pattern may be applied to the upper surface of the tile member providing an aesthetically pleasing appearance.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a paving stone system that will overcome the shortcomings of the prior art devices.

A second object is to provide a paving stone system for producing aesthetically pleasing paving stones in an efficient and cost effective manner.

Another object is to provide a paving stone system that requires a lower amount of clay or other valuable material.

An additional object is to provide a paving stone system that utilizes a large amount of concrete to form the basic structure.

A further object is to provide a paving stone system that may recycle waste materials such as fly ash.

Another object is to provide a paving stone system that may have various shapes and surface appearances that are aesthetically pleasing.

A further object is to provide a paving stone system that reduces the amount of energy utilized to create a paving stone.

Another object is to provide a paving stone system that will not easily fade or wear, stain.

A further object is to provide a paving stone system that can tolerate harsh climates and usage.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

Figure 1:
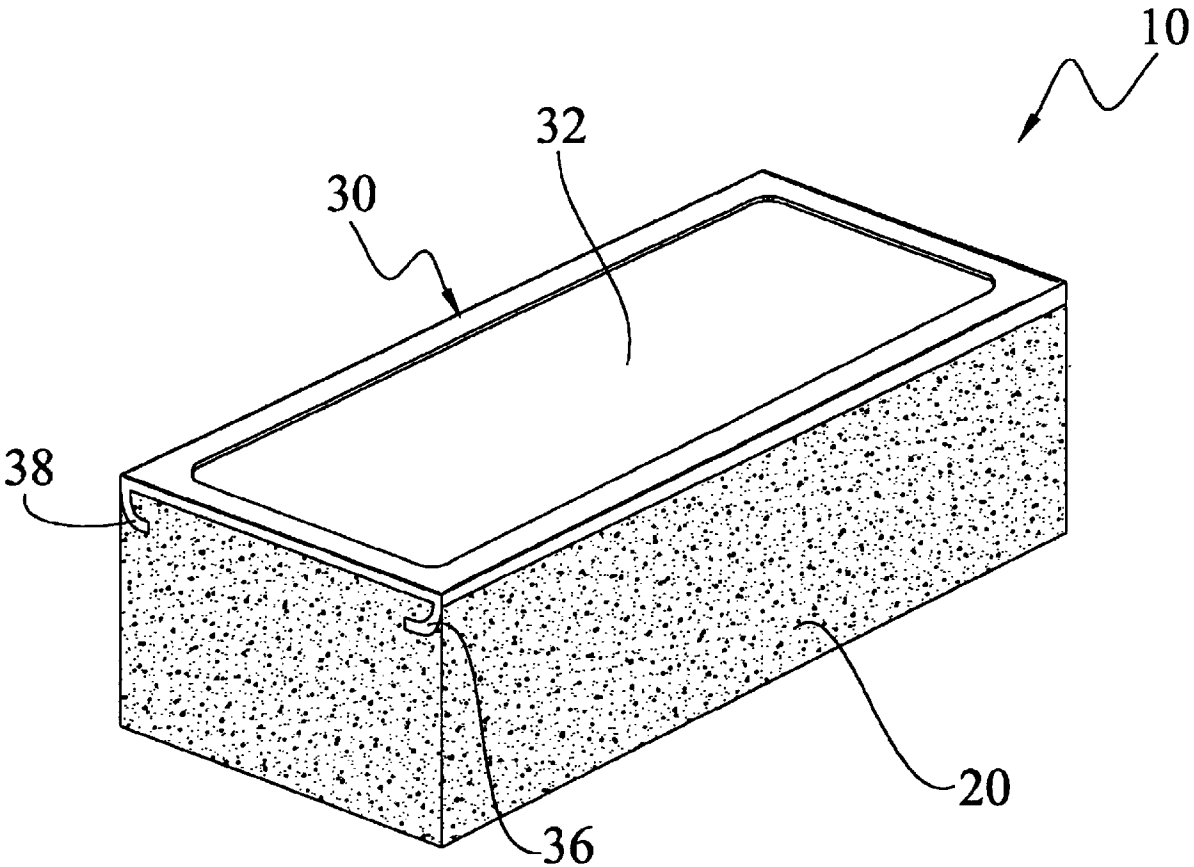
FIG. 1 is an upper perspective view of the present invention.

Turning now descriptively to the drawings, in which similar reference characters denote similar elements throughout the several views, FIGS. 1 through 5 illustrate a paving stone system 10, which comprises positioning a tile member 30 within a container 50, applying a bonding agent 40 to the tile member 30 and filling the container 50 with concrete. The tile member 30 is comprised of a flat portion having an upper surface 32 and a lower surface 34, a first side wall 36 extending from the lower surface 34 and a second side wall 38 extending from the lower surface 34. The first side wall 36 and the second side wall 38 are preferably curved inwardly toward one another to lock within the concrete. A unique pattern may be applied to the upper surface 32 of the tile member 30 providing an aesthetically pleasing appearance.

The tile member 30 is preferably formed from a clay or similar material. Common waste materials such as fly ash and glass may be added to the tile material for lowing the cost of the tile making process and to improve the properties of the raw material. The tile member 30 may be initially formed by various processes such as pressing, rolling or extrusion. Creative patterns may be created within the upper surface 32 of the tile member 30 utilizing conventional manufacturing processes well known within the paver and tile industries.

Once the tile member 30 is formed into the desired shape, the tile member 30 is then heated into a ceramic structure utilizing conventional tunnel kiln technology. A surface color and texture may be rolled or sprayed onto the tile member 30 prior to the heating process utilizing slip (clay and water), pigments (metallic oxides, etc.), sand and various other materials.

Figure 2:
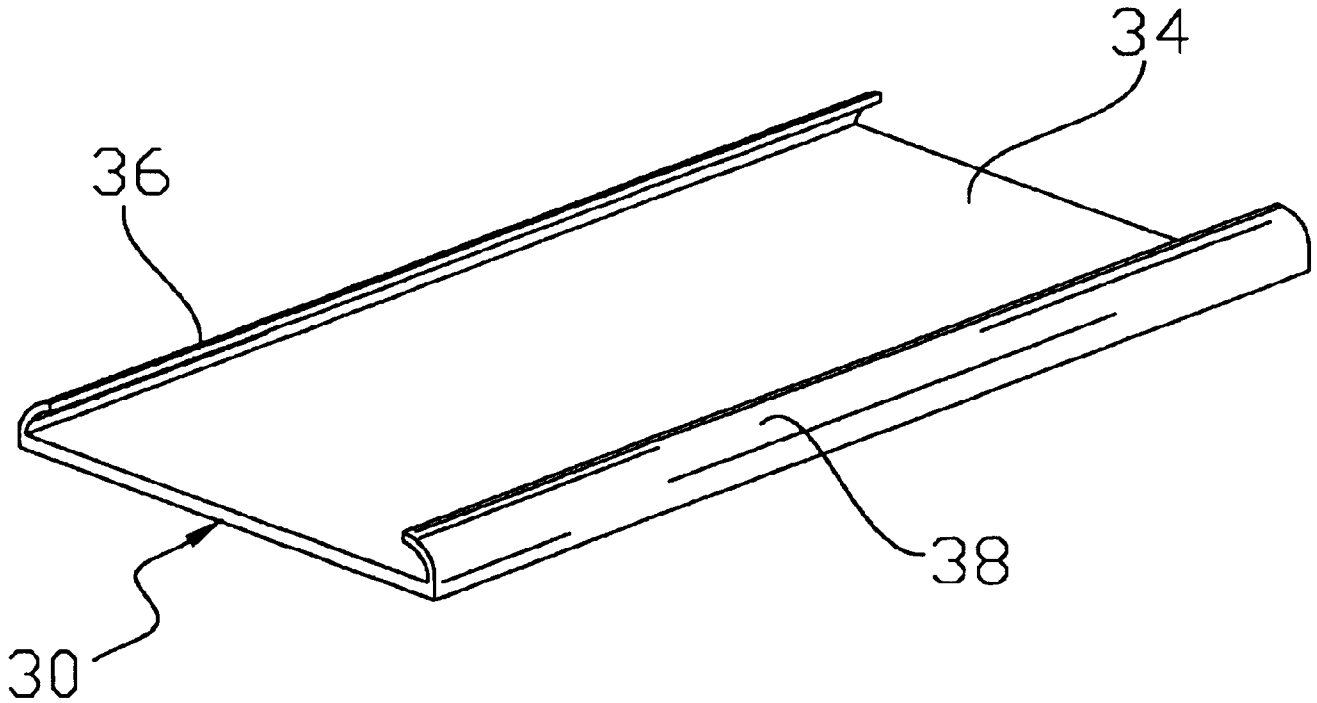
FIG. 2 is an upper perspective view of the tile member inverted with the lower surface facing upwardly.
Figure 3:
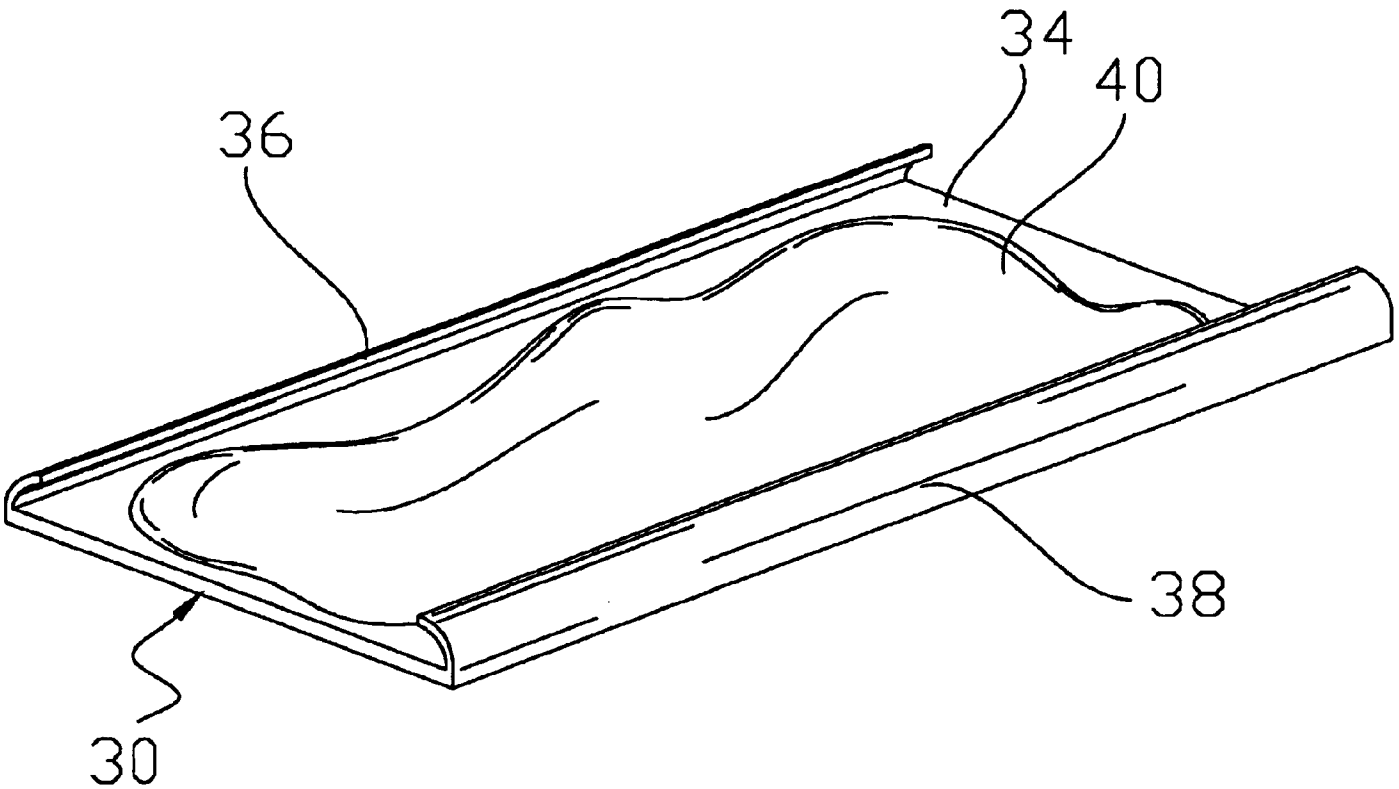
FIG. 3 is an upper perspective view of the tile member inverted with a bonding agent applied to the lower surface of the tile member.

As shown in FIGS. 1 through 3 of the drawings, the tile member 30 is preferably comprised of a rectangular structure. However, it can be appreciated that the tile member 30 may be comprised of various other well known shapes such as but not limited to circular, square, oblong, triangular, polygonal and the like. The tile member 30 has a middle flat portion having an upper surface 32 and a lower surface 34. The flat portion of the tile member 30 preferably has a height of less than 10% of the total height of the completed paving stone system 10 as shown in FIG. 1 of the drawings.

As further shown in FIGS. 1 through 3 of the drawings, a first side wall 36 and a second side wall 38 extend from opposing sides of the lower surface 34 of the tile member 30. It can be appreciated that one or more side walls may be utilized to form the tile member 30. The first side wall 36 and the second side wall 38 preferably extend downwardly and curve inwardly at an angle as shown in FIGS. 1 through 3. The curvature of the side walls 36, 38 may vary. FIG. 1 illustrates the side walls 36, 38 having a curved portion extending from the lower surface 34 of the tile member 30 and then extending relatively parallel to the lower surface 34 a finite distance. The side walls 36, 38 may also be angled inwardly at a desired angle less than ninety degrees. Various other shapes and structures may be utilized to construct the side walls 36, 38 as can be appreciated. The side walls 36, 38 lock the tile member 30 within the concrete portion 20 during the formation of the paving stone system 10.

After the tile member 30 has been created, the user then preferably applies a bonding agent 40 to the lower surface 34 of the tile member 30 to increase bonding between the tile member 30 and the concrete portion 20. The bonding agent 40 is not required for usage within the present invention, though preferred because of the increased bonding strength between the tile member 30 and the concrete portion 20. The bonding agent 40 may be comprised of any well-known bonding material utilized within the concrete or tile industries. For example, the bonding agent 40 may be comprised of an acrylic based bonding agent 40 or other suitable bonding agent 40. UNITEX INC. manufactures a product entitled PRO-PROXY 204 which is suitable for usage within the present invention.

Figure 4:
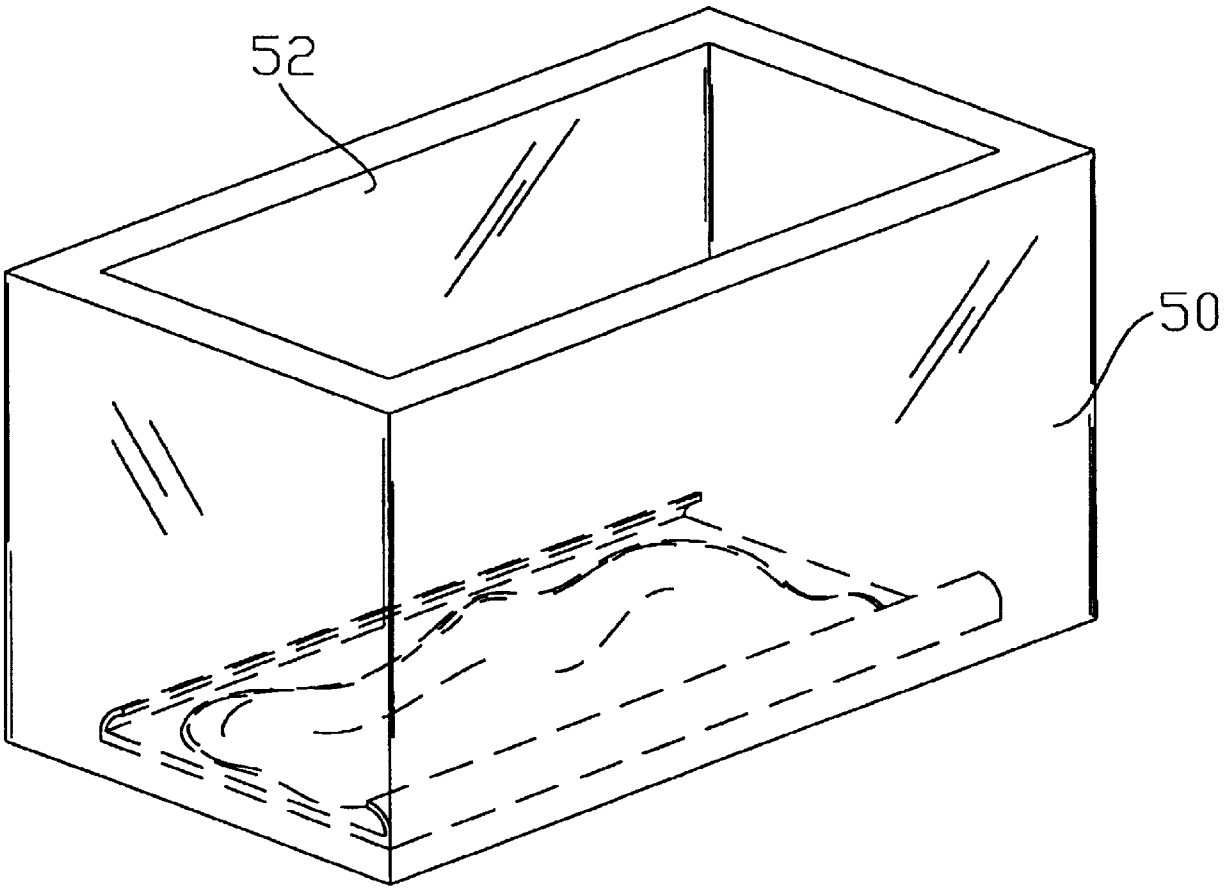
FIG. 4 is an upper perspective view of the tile member with bonding agent positioned within the container.

After applying the bonding agent 40 to the lower surface 34 of the tile member 30, the tile member 30 is positioned within a container 50 having an interior portion 52 formed within the shape of the paving stone system 10 as shown in FIG. 4 of the drawings. The container 50 serves as a mold for the paving stone system 10 creating the resulting shape of the paving stone system 10. The user positions the upper surface 32 to be juxtaposed to the floor of the container 50 with the lower surface 34 facing upwardly within the interior portion 52 of the container 50.

Figure 5:
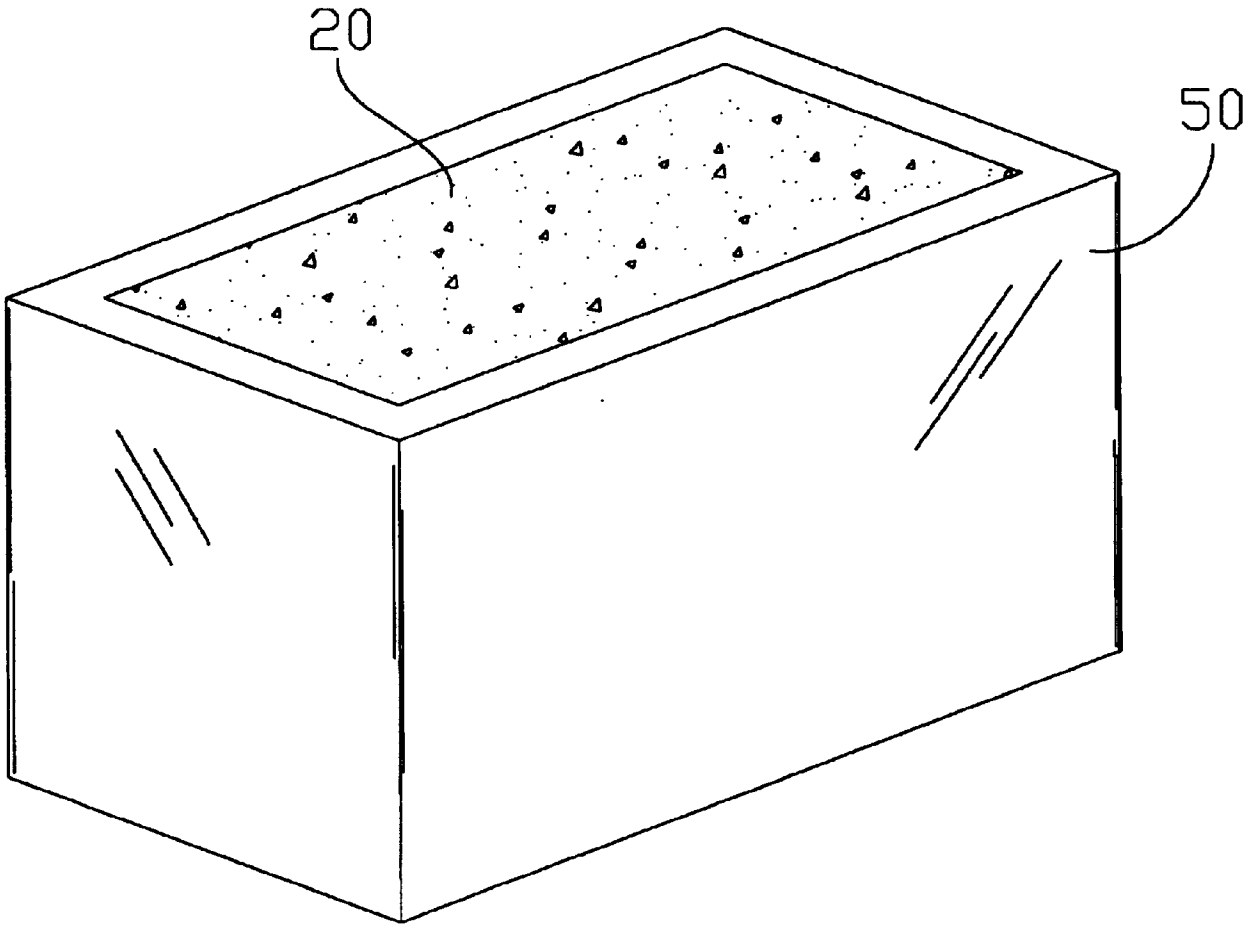
FIG. 5 is an upper perspective view of the concrete portion filling the interior portion of the container upon the tile member.

The user then pours a volume of concrete portion 20 into the interior portion 52 of the container 50 to the desired height as shown in FIG. 5 of the drawings. The concrete portion 20 may be comprised of any well known concrete composition such as cement and sand. The concrete portion 20 may also be comprised of a sand and lime (calcium silicate) composition. Fly ash and other materials may be added to the concrete portion 20 which is well known in the concrete industry. Water or other fluid is added to the composition to achieve the desired consistency. The concrete may be pressed or vibration-compacted into the container 50.

After the concrete portion 20 has hardened within the container 50 and bonded with the tile member 30, the user then removes the newly formed paving stone system 10 from the container 50. The paving stone system 10 is then utilized in construction with a plurality of other similar paving stone systems 10 wherein the upper surface 32 of the tile member 30 is facing upwardly to serve as a wear surface.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A paving stone, comprising:

a tile member comprised of a flat portion having an upper surface and a lower surface, and a first side wall and a second side wall extending from said lower surface away from said upper surface, wherein said first side wall and said second side wall curve inwardly toward one another; and a concrete portion secured to said lower surface of said tile member, wherein said concrete portion extends between and is in engagement with said first side wall and said second side wall.

2. The paving stone of claim 1, including a bonding agent between said concrete portion and said lower surface of said tile member.

3. The paving stone of claim 1, wherein said upper surface of said tile member is comprised of a design.

4. The paving stone of claim 1, wherein said flat portion of said tile member has a height less than 10 percent of the total height of the paving stone.

5. The paving stone of claim 1, wherein said tile member is comprised of a clay material.

6. The paving stone of claim 5, wherein said tile member has been heated creating a ceramic material.

7. The paving stone of claim 1, wherein said first side wall and said second side wall extend an entire length of said tile member.

8. The paving stone of claim 1, wherein said first side wall and said second side wall have a curved structure.

9. The paving stone of claim 1, wherein said concrete portion is comprised of a mixture of cement and sand.

10. The paving stone of claim 1, wherein said concrete portion is comprised of a mixture of lime and sand.

11. The paving stone of claim 1, wherein said concrete portion includes a volume of a waste material.

12. The paving stone of claim 1, wherein said concrete portion has the same width as a width of said tile member.

13. The paving stone of claim 1, wherein said concrete portion is formed within a container having an interior portion shaped to a desired shape.

14. The paving stone of claim 1, wherein said tile member and said concrete portion have a rectangular shape with a longitudinal axis.

15. A method of manufacturing a paving stone, comprising the steps of:

(a) providing a tile member comprised of a flat portion having an upper surface and a lower surface, and a first side wall and a second side wall extending from said lower surface away from said upper surface, wherein said first side wall and said second side wall curve inwardly toward one another;

(b) positioning said tile member within a mold container having an interior portion such that said upper surface of said tile member is adjacent a floor within said mold container; and (c) pouring a concrete mixture within said mold container to a desired height, wherein said concrete mixture extends between and is in engagement with said first side wall and said second side wall.

16. A method of manufacturing a paving stone, comprising the steps of:

(a) providing a tile member comprised of a flat portion having an upper surface and a lower surface, and a first side wall and a second side wall extending from said lower surface away from said upper surface, wherein said first side wall and said second side wall curve inwardly toward one another;

(b) applying a bonding agent to said lower surface of said tile member;

(c) positioning said tile member within a mold container having an interior portion such that said upper surface of said tile member is adjacent a floor within said mold container; and (d) pouring a concrete mixture within said mold container to a desired height, wherein said concrete mixture extends between and is in engagement with said first side wall and said second side wall.

* * * * *